US005930868A

United States Patent [19]

Butler

[11] Patent Number: 5,930,868

[45] Date of Patent: Aug. 3, 1999

[54] OLIVE KNUCKLE HINGE

[75] Inventor: Rhett Butler, New York, N.Y.

[73] Assignee: Edward R. Butler Company, Inc., New York, N.Y.

[21] Appl. No.: 08/987,003

[22] Filed: Dec. 8, 1997

[51] Int. Cl.[6] ..... E05D 11/04; E05D 5/10

[52] U.S. Cl. ..... 16/276; 16/386

[58] Field of Search ..... 16/273–276, 386; 403/164; 384/571

[56] References Cited

U.S. PATENT DOCUMENTS

| | | | |
|---|---|---|---|
| 90,330 | 5/1869 | Wolters | 16/386 |
| 698,884 | 4/1902 | Wheeler | 16/275 |
| 863,128 | 8/1907 | Aebi | 16/274 |
| 1,600,534 | 9/1926 | Carr | 384/571 |
| 1,738,015 | 12/1929 | Parsons | 16/275 |
| 1,833,328 | 11/1931 | Morris | 16/276 |
| 1,995,838 | 3/1935 | Buckwalter | 384/571 |
| 2,566,504 | 9/1951 | Soss | 16/275 |
| 2,748,420 | 6/1956 | Clover | 16/276 |
| 3,349,427 | 10/1967 | Cairns et al. | 16/386 |
| 3,626,547 | 12/1971 | Werner | 16/275 |
| 4,864,690 | 9/1989 | Chen | 16/274 |
| 5,251,987 | 10/1993 | Supanz | 384/571 |

FOREIGN PATENT DOCUMENTS

| | | | |
|---|---|---|---|
| 526794 | 3/1954 | Belgium | 16/386 |
| 0994970 | 11/1951 | France | 16/275 |
| 1233301 | 1/1967 | Germany | 16/275 |
| 0445625 | 10/1949 | Italy | 16/275 |
| 0514194 | 7/1956 | Italy | 16/275 |
| 371361 | 9/1963 | Switzerland | 16/276 |
| 0005146 | 3/1912 | United Kingdom | 16/275 |
| 779797 | 7/1957 | United Kingdom | 16/386 |
| 0902488 | 8/1962 | United Kingdom | 16/274 |

*Primary Examiner*—Chuck Y. Mah
*Attorney, Agent, or Firm*—Kaplan & Gilman, LLP

[57] ABSTRACT

An improved olive knuckle hinge is described wherein, shaft and thrust bearings in addition to a compression trapped pivot shaft are utilized to: reduce wear and friction, increase load handling capabilities and to provide for a space between the two hinge knuckles. In this space previously occupied by a thrust bearing, may now be placed a decorative ring, or it may be omitted all together as the weight of the door is no longer transmitted through this space.

7 Claims, 5 Drawing Sheets

OLIVE KNUCKLE HINGE

TECHNICAL FIELD

The present invention relates to an improved design of hinge with superior wear and loading capabilities as well as increased decorative design possibilities.

BACKGROUND OF THE INVENTION

Olive Knuckle hinges, some times also referred to as cocoon hinges have been manufactured without much change in design for well over 200 years. An example of a prior art hinge may be seen in U.S. Pat. No. 2,566,504 to Soss. Additional examples may be viewed in the Stanley catalog #15 circa 1910 page 31, the Stanley 1997 catalog page 81, the Yale catalog #26 1926 page 480, the Rixson catalog of January 1930 page 6, the P. E. Guerin period hardware catalog of 1914 page 316, and the P. E. Guerin 1997 catalog.

These hinges involve two halves each with a leaf and a knuckle, a pivot shaft partially inserted into a bore between each knuckle and a thrust bearing between the two knuckles, trapped in place by the pivot shaft running through it. Usually the pivot shaft is pressed into one knuckle. The portion of the half that is designed to be attached to a door or frame is referred to as the leaf, and the thickened portion of each half which mates with a pivot shaft is referred to as the knuckle.

The only provision for a bearing in the prior art designs is the central ring thrust bearing. If all the weight of the connecting door were directly in line and above the pivot shaft of the hinge, this would be a good design. The weight however, is not directly above nor inline with the pivot shaft. The weight of the door extends out several feet from the hinge. This puts a great cantilever force on the pivot shaft, the surrounding bore of the hinge knuckles, as well as an uneven force on the thrust bearing. This uneven cantilever force causes the bores in each hinge to wear quickly and unevenly, causing a loose and imperfect fit. The thrust bearing also wears quickly in an uneven pattern preventing a smooth and easy motion of the hinge.

Although beautiful in appearance, because of their wear problems, prior art knuckle hinges are recommended by their manufacturers only for use on low frequency, light weight doors.

An additional problem with the prior art is that the thrust bearing is a central visual point of the hinge, and due to its necessity to bear weight it cannot be made to be decorative nor of non-load-bearing materials.

Accordingly there exists a need in the art for an improved knuckle hinge which provides for reduced wearing, increased loading capabilities and which allows for the central thrust bearing ring to be eliminated or made a decorative element.

SUMMARY OF THE INVENTION

The above and other problems of the prior art have been solved and a technical advance is achieved in accordance with the present invention of an improved hinge. In accordance with the invention, into the inside of the bore in each knuckle of the hinge is pressed a needle roller bearing. At the bottom of the bore in each knuckle is a single ball bearing, so that the pivot shaft with its ends slightly domed, contacts the ball bearing on either end. This creates a tangential pivotal bearing contact thereby minimizing friction. Additionally, the pivot shaft is long enough so that when the two knuckles of the hinge are connected with the pivot shaft, a space between the two knuckles is created. This space is to be used for a decorative ring. Said decorative ring's height being equal to or less than the height of the created space. Accordingly, this ring which was previously a load sustaining thrust bearing, no longer need bear any load and may now be made of non-load-bearing and/or decorative materials such as wood, leather, stone, porcelain, or other materials which may not otherwise be capable of sustaining a load.

DETAILED DESCRIPTION OF THE PREFERRED EMBODIMENT

Figure 1:
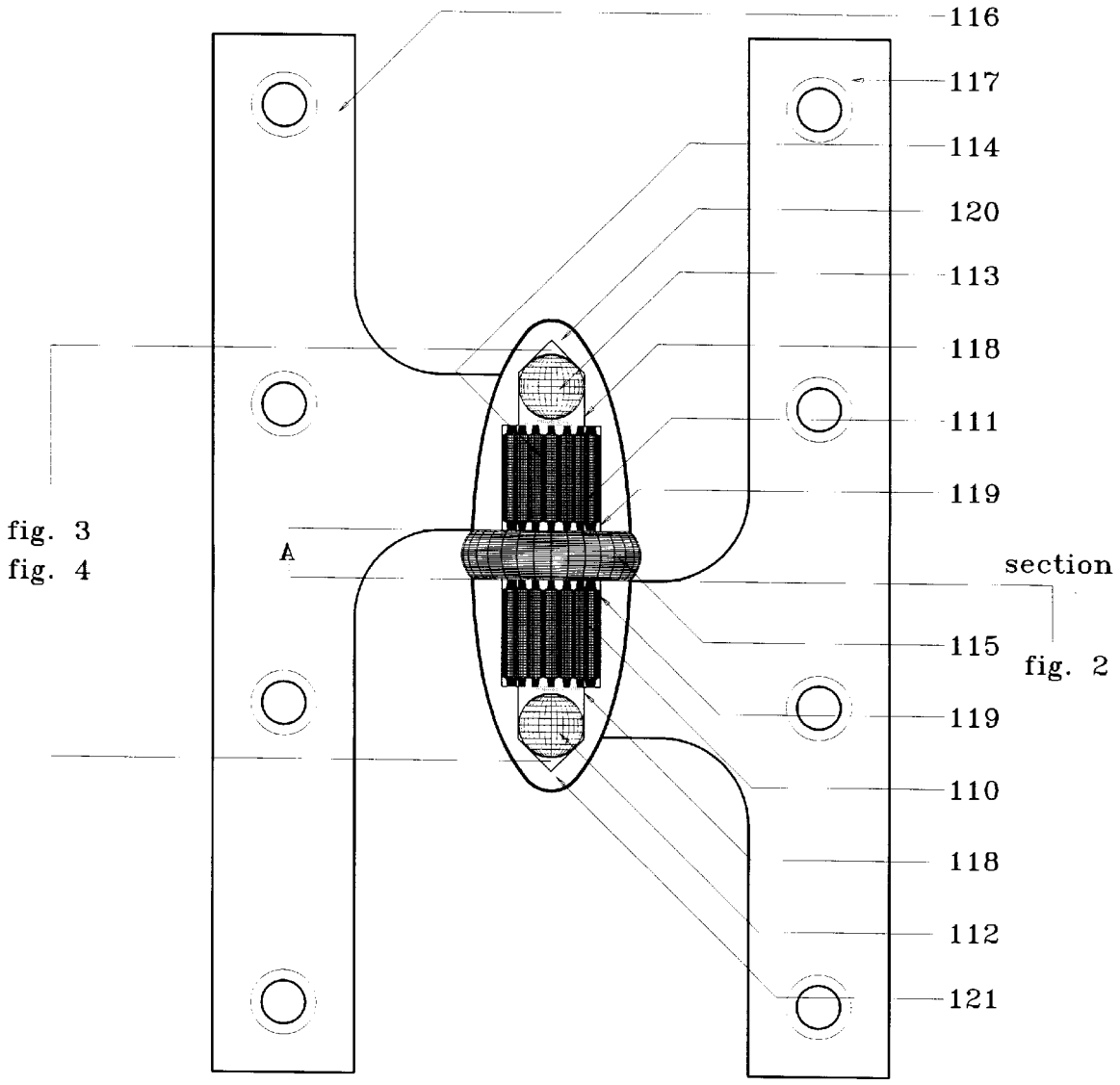
FIG. 1 shows a front elevation view of the novel hinge in accordance with the present invention.

FIG. 1 shows a front elevation view of the inventive hinge including first and second hinge leaves (116 and 117) respectfully, connected by a pivot shaft (114). The domed pivot shaft (114) is preferably made from hardened steel, while the hinge leaves may be made from brass, bronze, aluminum or other suitable alloy. Brass, bronze and other copper alloys being ideal for receiving decorative plated and/or patinated finishes. Ball bearings (112 and 113) are preferable made from hardened steel, so that the pivot points of the hinge are a hardened steel to hardened steel connection. Each knuckle (120 and 121) includes a bore (118), and a single ball bearing (112 or 113) pressed into the bottom thereof. Shaft bearings (110 and 111) are pressed into another bore (119). The pivot shaft (114), which is removable from both knuckles (120 and 121), rests against the ball thrust bearings (112 and 113) on each end and has any cantilever forces supported by shaft bearings (110 and 111). The shaft bearings (110 and 111) are preferably needle roller bearings, this will allow for heavier loading of the hinge than ball race, sleeve or other type bearings.

Importantly, the decorative ring (115) does not bear the majority or any, of the load tending to press the leaves (116 and 117) or knuckles (120 and 121) together. Specifically, it can be appreciated that the diameters of the ball thrust bearings (112 and 113) when added to the length of the pivot shaft (114) are selected so that space A is created, which is preferably equal to or greater in height than the height of ring (115). This provides for the decorative ring not to bear the load of the door. Rather, the load is transmitted through the first set of thrust and shaft bearings, through the pivot shaft, and then through the second set of thrust and shaft bearings.

Figure 2:
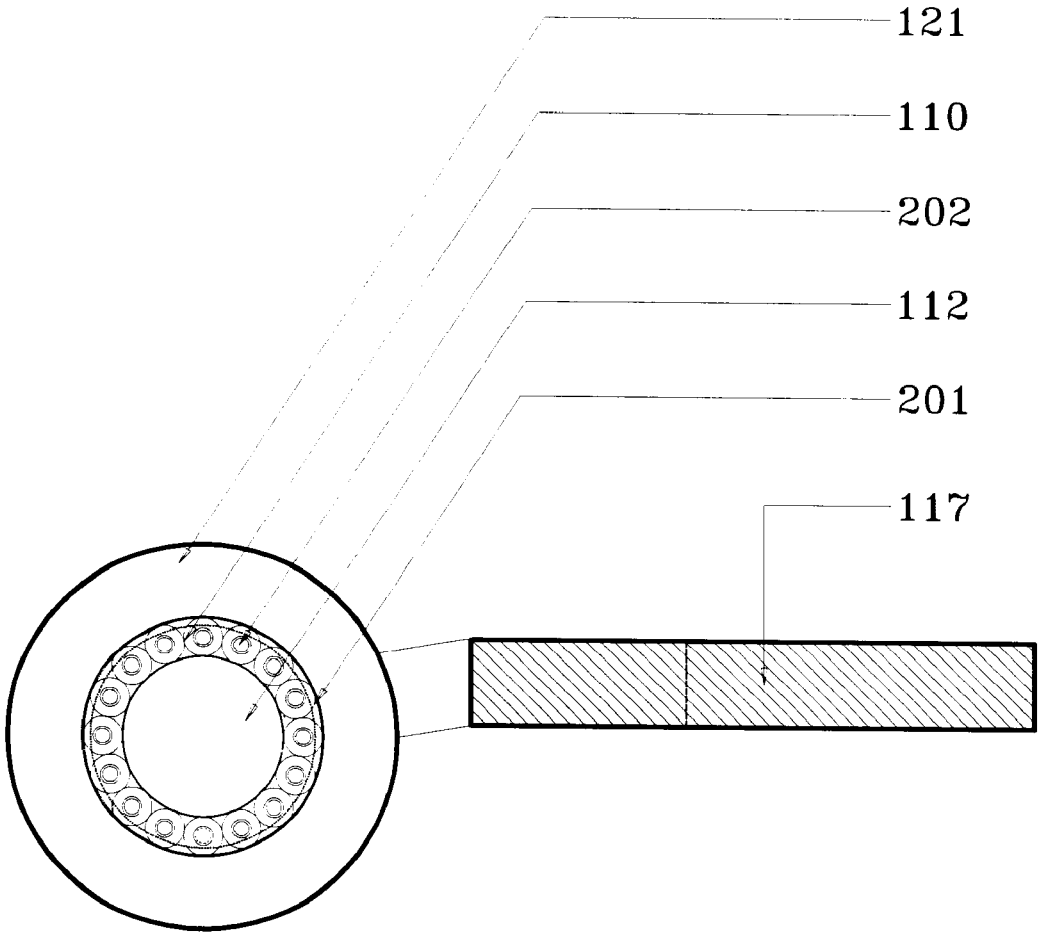
FIG. 2 is a plan view looking into the bore in one side of the inventive hinge.

FIG. 2 shows a plan view looking downward into the bore (119) of one of the hinge knuckles (120 or 121). The arrangement of FIG. 2 includes the brass or other material knuckle (120 or 121), a shaft roller bearing (110 or 111), and the thrust ball bearing (112 or 113). Like parts have been designated with the same numerals from FIG. 1. The bearing comprises a frame (201) and plurality of rollers (202).

Figure 3:
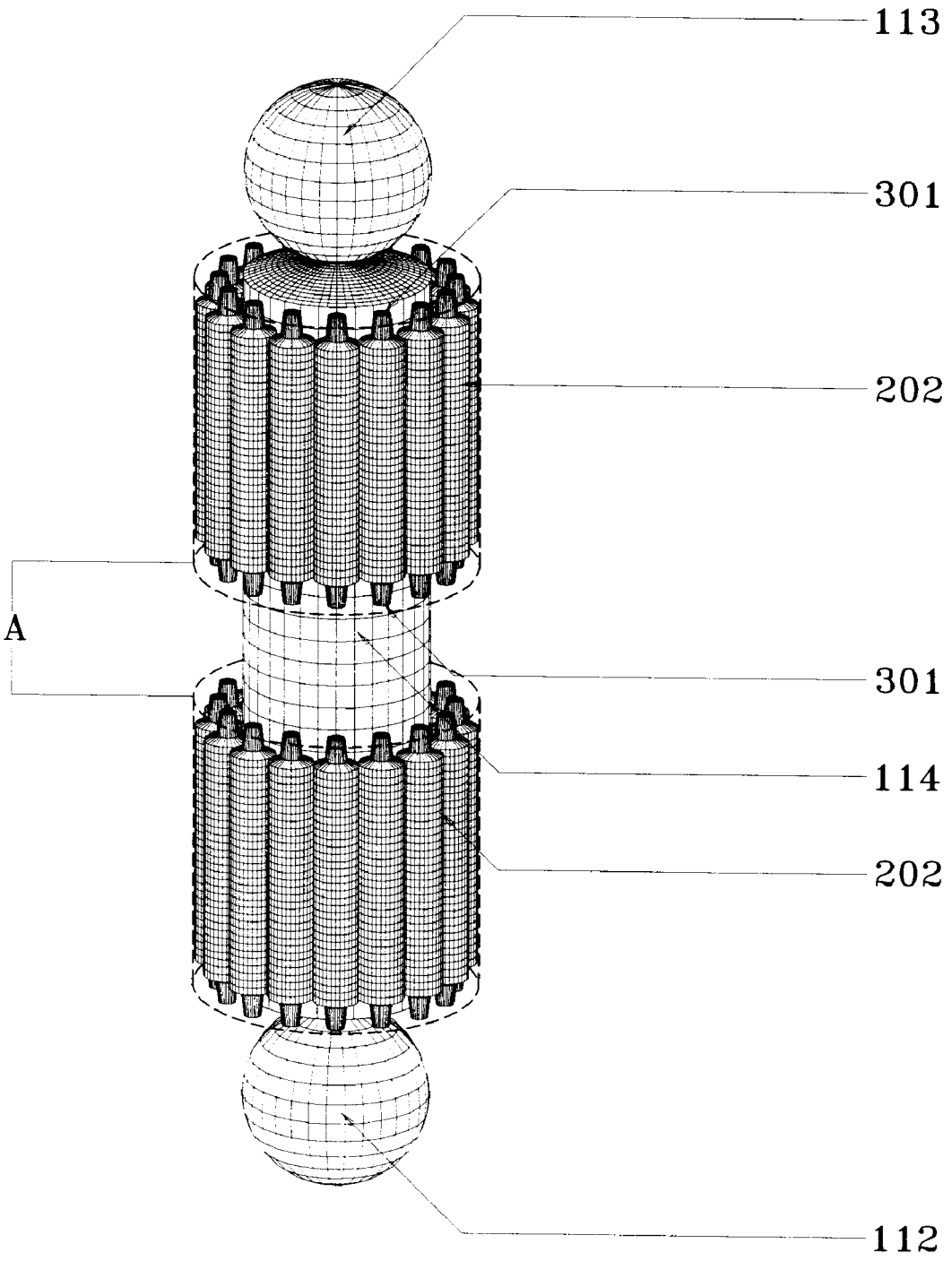
FIG. 3 is an axonometric sectional depiction of the internal components of the inventive hinge.

FIG. 3 shows an axonometric sectional depiction of the internal components of the inventive hinge without the two knuckles (120 and 121) that cover them. Like parts have designated with the same numerals from FIG. 1. For clarity only the rollers of the shaft bearings have been depicted.

Figure 4:
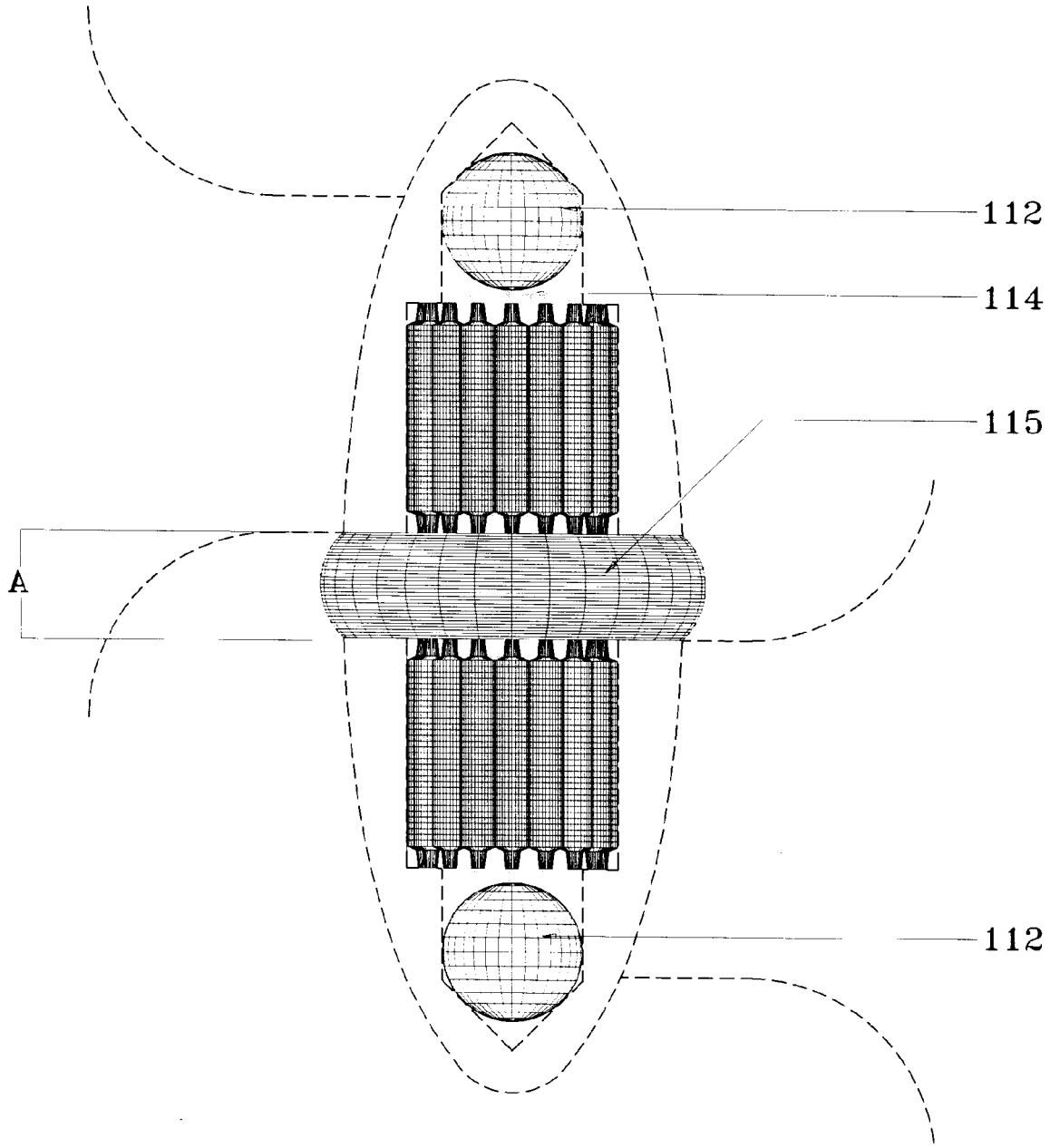
FIG. 4 is a front sectional depiction of the internal components of the inventive hinge with the leaves and shaft bearing cases shown transparent.

FIG. 4 shows a front sectional depiction of the internal components of the inventive hinge in relation to the hinge knuckles (120 and 121) and non load-bearing ring (115). The leaves, knuckles and bearing casings are depicted transparent.

As previously indicated, ball thrust bearings (112 and 113) are positioned at the bottom of the bore within each knuckle as shown in FIG. 1, and the pivot shaft (114) contacts thrust bearings (112 and 113) and shaft bearings (110 and 111) to support the weight of a connected door. The decorative ring (115) occupies the space A and may support none of the weight of the door.

It can be appreciated from the above that the novel hinge provides a technique of reducing wear and removing the weight off of the previously used central thrust bearing ring, permitting any material to be used for this now decorative ring. Additionally, friction and wear is reduced, and the loading capabilities of the hinge are increased. In fact a prior art hinge, placed on a particularly heavy door in a high traffic area, could wear out in a matter of weeks, whereas a hinge of the inventive design could last in the same application for the life of the building.

Figure 5:
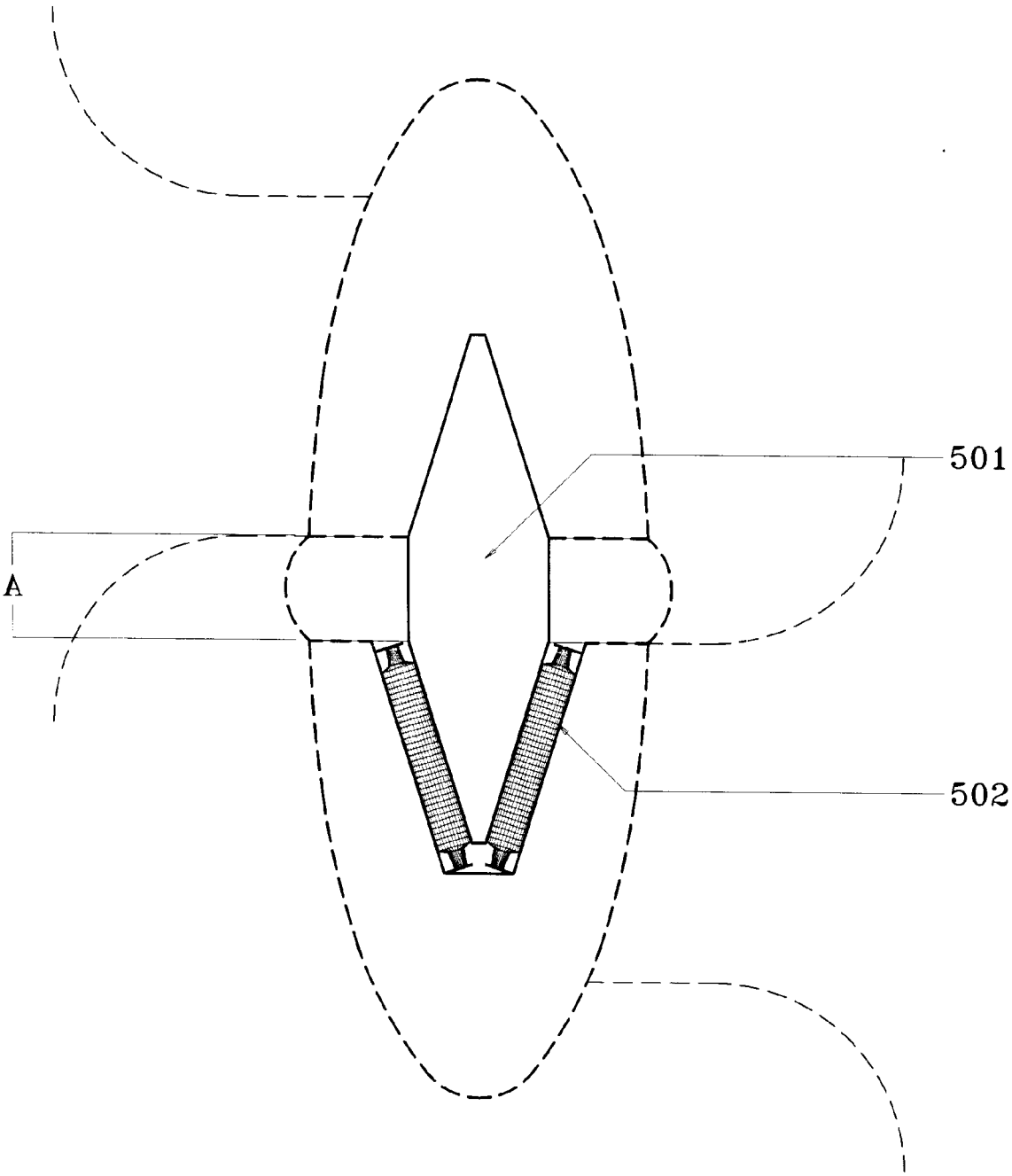
FIG. 5 is a portion of an alternative embodiment of the invention.

FIG. 5 shows a portion of a slightly different embodiment of the present invention. The cylindrical shaft (114) has been replaced with a tapered shaft (501). Additionally, the standard shaft bearings and the thrust bearings are no longer utilized. Instead, each set is replaced with a single special roller bearing (502). Bearing (502) has its rollers arranged in a conical fashion matching the taper of the pivot shaft. This special design of bearing functions as both a thrust and a shaft bearing. In this design of tapered bearing the individual rollers may be cylindrical or conical, as long as they are arranged to contact the tapered surface of pivot shaft (501).

While the above describes the preferred embodiment of the invention, various modifications and/or additions will be apparent to those of ordinary skill in the art. Such variations and/or claims are intended to be covered by the following claims.

I claim:

1. A hinge comprising:

two hinge knuckles connected by a pivot shaft, said pivot shaft supported on each end by a bail bearing, said pivot shaft having a circumference, said hinge knuckles each having an inside, the inside of each of said hinge knuckles having a length, and a plurality of elongated shaft bearings, disposed substantially entirely around said circumference, and extending substantially the length of the inside of each of said hinge knuckles such that the pivot shaft is separated from the inside of each of said hinge knuckles and is supported substantially entirely by said shaft bearings and said ball bearings.

2. The hinge of claim 1 wherein the pivot shaft has ends and wherein the ends are shaped into a dome.

3. The hinge of claim 1 wherein the shaft bearings are roller bearings.

4. The hinge of claim 3 wherein said hinge knuckles are compressed toward each other from opposite ends of said shaft, and wherein said shaft is sufficiently long such that despite such compression, said shaft maintains a separation of a predetermined distance, and further comprising a ring disposed around said shaft, in said separation, said ring having a thickness less than said predetermined distance such that said ring does not bear a force of said compression.

5. The hinge of claim 4 wherein at least one end of said shaft is tapered.

6. The hinge of claim 1 wherein at least one end of said shaft is tapered.

7. The hinge of claim 3 wherein at least one end of said shaft is tapered.

* * * * *